United States Patent [19]

Yamazoe

[11] Patent Number: 4,955,472

[45] Date of Patent: Sep. 11, 1990

[54] GOLF BAG WITH A CLUB SECURING DEVICE

[75] Inventor: Wataru Yamazoe, No. 17-14, 4-chome, Todoroki, Setagaya-ku, Tokyo, Japan

[73] Assignees: Wataru Yamazoe, Tokyo; Takahiro Yamazoe, Toyohashi; Makiko Yamazoe; Yuriko Yamazoe, both of Tokyo, all of Japan; a part interest to each

[21] Appl. No.: 376,308

[22] Filed: Jul. 6, 1989

[30] Foreign Application Priority Data

May 26, 1989 [JP] Japan ..... 1-61076[U]

[51] Int. Cl.[5] ..... A63B 55/00

[52] U.S. Cl. ..... 206/315.6; 206/315.3; 206/315.4; 150/160

[58] Field of Search ..... 206/315.6–315.8, 206/315.2–315.5, 315.4; 248/96; 211/70.2; 150/159, 160

[56] References Cited

U.S. PATENT DOCUMENTS

| | | | |
|---|---|---|---|
| 1,599,170 | 9/1926 | Fatjo | 206/315.6 |
| 1,780,802 | 11/1930 | Sutcliffe | 206/315.6 |
| 1,838,699 | 12/1931 | McMonies et al. | 206/315.6 |
| 1,968,723 | 7/1934 | Thorsen | 206/315.6 |
| 2,708,955 | 5/1955 | Wilkens | 206/315.6 |
| 3,331,419 | 7/1967 | Bencriscutto | 206/315.6 |
| 4,174,747 | 11/1979 | Boles | 206/315.6 |
| 4,208,227 | 6/1980 | Cowan | 206/315.6 |
| 4,311,178 | 1/1982 | Kennedy | 206/315.6 |
| 4,383,563 | 5/1983 | Kirchoff, Jr. | 206/315.3 X |
| 4,685,561 | 8/1987 | Reimers | 206/315.6 |

FOREIGN PATENT DOCUMENTS

| | | | |
|---|---|---|---|
| 198812 | 6/1923 | United Kingdom | 206/315.2 |
| 291934 | 6/1928 | United Kingdom | 206/315.3 |
| 438747 | 11/1935 | United Kingdom | 206/315.5 |
| 859116 | 1/1961 | United Kingdom | 206/315.7 |

*Primary Examiner*—Sue A. Weaver

*Attorney, Agent, or Firm*—Dilworth & Barrese

[57] ABSTRACT

The present invention discloses a novel golf bag provided with an inlet or compartment exclusively for inserting a putter thereinto through said inlet.

The putter inserted into said golf bag through the inlet can be retained within the bag safely and stably even in carriage or transportation of the bag by mounting another partition frame between the partition frames mounted at the opening of a conventional golf bag.

15 Claims, 2 Drawing Sheets

GOLF BAG WITH A CLUB SECURING DEVICE

BACKGROUND OF THE INVENTION AND RELATED ART

As illustrated in FIG. 1, an opening of a golf bag is generally partitioned into three inlets for receiving a golf club into the golf bag therethrough. According to the Figure, a wood club is inserted into the bag through an upper inlet; an iron club with a long shaft is inserted into the bag through an intermediate inlet and an iron club with a short shaft is inserted into the bag through a lower inlet so as to insert each separate club into the golf bag.

However, according to a conventional golf bag as above described, an inlet for inserting a putter into the golf bag therethrough has not been mounted particularly. It can be assumed that the wood and iron clubs are in large numbers. Accordingly it is easy to pick up the clubs selectively in playing golf when the clubs are inserted into the bag by partitioning the inlets as described above. Further, it is convenient to confirm the existence and number of the clubs to be used. Regarding the putter, on the other hand, it can easily be distinguishable owing to its unique shape even when the putter is inserted into the bag through the inlets with the iron or wood club. Further, the putter is often kept separately from the wood or iron club in playing golf. Thus, there seems no necessity of mounting an inlet exclusively for inserting the putter into the bag therethrough.

As a result, the putter is easily and simply inserted into the golf bag through the inlets for inserting a wood or iron club into the bag.

However, it may be noted that a golf club is made of a metal except for the wooden portion of a wood club. Accordingly transportation or carriage of the clubs is usually undertaken somewhat roughly. As a result the face of a putter is sometimes damaged by receiving the impact of the face of an iron club or the shaft thereof oscillating vigorously within the golf bag.

SUMMARY OF THE INVENTION

With the above in mind, it is an object of the present invention to provide a golf bag capable of protecting the face of a putter without causing damage of the face of a putter inserted into the golf bag.

The aforementioned object can be attained by a golf bag comprising an inlet or compartment exclusively for inserting a putter into a golf bag through said inlet or compartment being partitioned in between two partition frames constituting inlets or compartments for inserting a plurality of clubs mounted at an opening of the golf bag.

Since the inlet or compartment exclusively for inserting the putter into the golf bag is mounted by partitioning two partition frames mounted at an opening of the golf bag, the putter can be inserted thereinto in a manner that the head of a putter is suspended across each upper edge of said two partition frames and accordingly the head can thus be held without moving from said inlet or compartment, thereby preventing bumping the other clubs. Furthermore, a cover belt for protecting the face of a putter may be arranged at the inlet or compartment for exclusively inserting a putter into the bag so as to protect the putter completely.

BRIEF DESCRIPTION OF THE DRAWINGS

In the Figures.

DESCRIPTION OF THE PREFERRED EMBODIMENTS

Hereinafter, embodiments according to the present invention will be described in detail with reference to the drawings.

Figure 1:
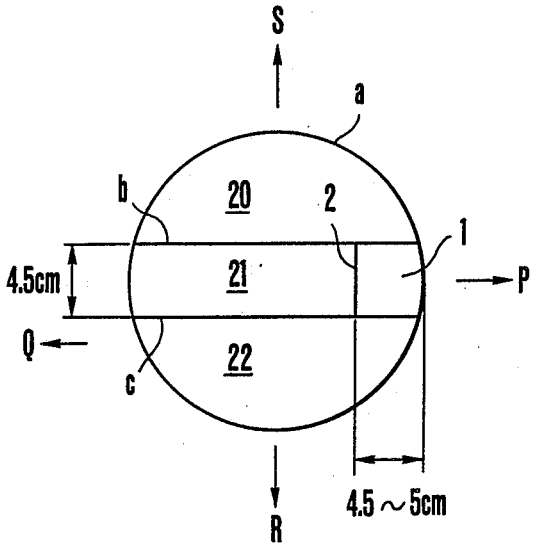
FIG. 1 is a schematic view in plan of the opening of a golf bag according to the present invention.

FIG. 1 is a schematic view in plan of an opening, with 8 inches longitudinal length for example, of a golf bag. The opening of a golf bag (a) is generally partitioned into three inlets or compartment (20) (21) (22) for inserting clubs into a golf bag by means of two partition frames (b) (c).

Through the inlet or compartment (20), a wood club is inserted into the bag. An iron club with a comparatively long shaft is inserted into the bag through the inlet or compartment (21) and an iron club with a short shaft is inserted into the bag through the inlet or compartment (22).

The two partition frames (b) (c) are mounted across the inner surface of the golf bag (a) and both ends thereof are held by firmly fitting to said inner surface. A space between said two partition frames is arranged to be approximately 4.5 cm. (Some dispersion may be observed). When iron clubs No. 3–9 and two pieces of wedge clubs are inserted thereinto, five pieces of iron clubs No. 3–7 for example are inserted thereinto through the inlet (21), i.e. between the partition frames (b) (c) and the remaining iron clubs No. 8–9 and two pieces of wedge clubs, totaling to four pieces of the club are inserted thereinto through the inlet (22).

An inlet or compartment for exclusively inserting a putter into the bag is mounted by partitioning the space between the aforementioned two partition frames (b) (c). Said inlet may be constituted by mounting another partition frame (2) between the partition frames (b) (c). Further both ends of said partition frame (2) are firmly fixed to each side face of said two partition frames (b and c). Alternatively, the inlet compartment for exclusively for receiving the putter may be constituted in a manner such that the partition frame (2) and the two partition frames (b) (c) are integrally made and thereafter said inlet or compartments thus constituted with the two partition frames may be fixed to the opening of the bag, thereby constituting the inlets or compartments (1) (20) (21) (22) simultaneously. An aperture of said inlet (1) is arranged to be a square of 4.5 cm approximately and it may also be constituted to be a rectangle, one side of which is approximately 4.5 cm and less. However, the length of the head of a putter is about 10–12 cm and it is preferable to arrange the aforementioned aperture to prevent both ends of the putter suspended across the two partition frames (b) (c) from touching curved portions of the golf bag.

Since the inlet or compartment (1) is mounted adjacent to the inlet compartment (21) for receiving five pieces of an iron club into the bag, the face of a putter merely touches the face of a limited number of the iron clubs (one or two pieces) when the golf bag in inclined toward the direction of P and damage of said putter can be prevented by providing the cover belt. When the golf bag is inclined toward the direction of S, R or Q, there is no fear that the putter touches the other clubs.

Figure 2:
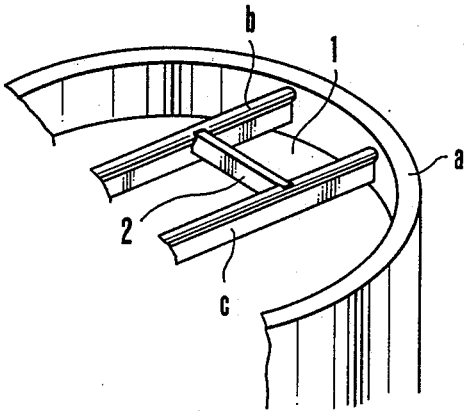
FIG. 2 is a schematic view, being partially cut, of one embodiment of an inlet or compartment for exclusively receiving a putter into the golf bag according to the present invention.

FIG. 2 is one embodiment according to the present invention wherein an inlet or compartment for inserting a putter into a golf bag is mounted at the opening of a conventional golf bag provided with two partition frames.

(1) is the inlet or compartment for inserting the putter into the body. (2) is another partition frame. Said partition frame (2) is mounted across two partition frames (b) (c) and the both ends thereof are fixed to each side edge. The partition frame (2) may be mounted in the vicinity of fixed ends of said two partition frames (b and c) to the golf bag (a).

Figure 3:
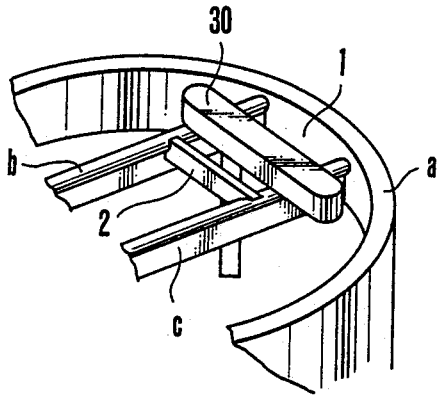
FIG. 3 is an explanatory view of use of the inlet in FIG. 2.

FIG. 3 shows a condition in which the putter is inserted into the bag through the inlet (1). A head of a putter (30) is inserted thereinto in a manner such that said head is suspended across the two partition frames (b) (c) and there is no fear that the putter thus suspended moves outside the inlet or compartment (1), thereby reducing chance of touching the faces of the other clubs.

Figure 4:
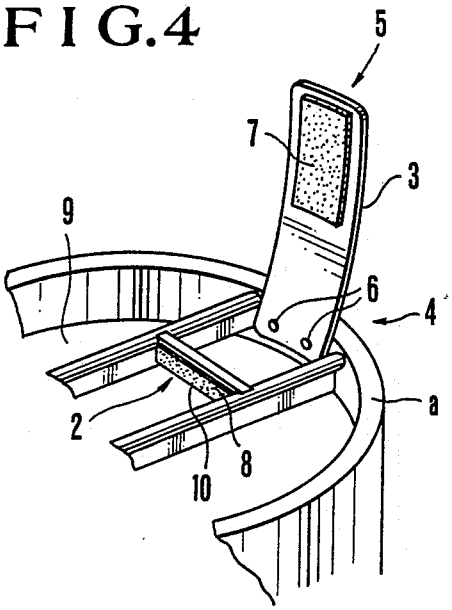
FIG. 4 is a schematic view of another embodiment of the present invention wherein a cover belt for protecting the putter is mounted.

FIG. 4 is another embodiment according to the present invention wherein a cover belt (3) is mounted at the inlet or compartment (1) in order to protect the face of a putter.

The cover belt (3) is made of leather or plain weave fabric etc containing rubber and is employed for protecting the head of a putter inserted into the bag through the inlet (1). A configuration of said cover belt (3) shows the shape of a band as illustrated in the Figure, but it may also be constituted in a manner such that a wing portion extending to both sides from the both ends at middle in a longitudinal direction of the cover belt is arranged to cover fully said head on the whole.

One end of the cover belt is fixed to an inner surface (9) of the bag between the two partition frames (b) (c) and the other end thereof is latched to one side (10) of the partition frame (2), thereby covering the face of a putter for the protection thereof.

According to the above embodiment, one end (4) of the cover belt (3) is hooked up onto the inner surface (9) of the golf bag by means of hooks (6) (6). A cotton tape or magic tape (7) is mounted at the back of the other end (5) of said cover belt and a cotton tape or magic tape (8) is further mounted at one side (10) of the partition frame (2). A fitting end (5) of the cover belt (3) is latched to said one side (10) of the partition frame (2) by adhesion of the cotton or magic tapes. Therefore, the cover belt (3) is fixed (6) to an inner surface (9) of the golf bag (a) at one end thereof, and is furthermore freely detachably latched to one side (10) of the partition frame (2).

Regarding fitting of the cover belt (3) to the inner surface of the golf bag, said cover belt can also be fastened with a pin or the one end (4) of the cover belt may be detachably free-fitted to the inner surface of the bag.

As illustrated in FIG. 3 and FIG. 4, when the head of a putter (30) is inserted into the bag through the inlet or compartment (1) so as to cover said head with the cover belt (3) by latching the other end (5) of said cover belt to the one side (10) of the partition frame (2), at least the face of a putter can completely be covered with said cover belt (3), thereby preventing damage of the face of a putter due to touching the faces of the iron clubs or the shafts thereof.

As described above, according to the present invention, since the inlet or compartment exclusively for receiving a putter into a golf bag is mounted, the putter can be retained safely at a prescribed place within the bag even in carriage or transportation of said bag, thereby preventing damage to the face of a putter. Furthermore, there is no fear that the head of a putter bumps the other clubs and thus each golf club can be brought into the golf bag systematically.

What is claimed is:

1. Device for holding a golf club in a golf bag, comprising two partition frames mounted upon a golf bag in an opening thereof to define a space therebetween, and means for partitioning said space defined between said two partition frames to define an inlet or compartment for receiving a golf club, said partitioning means comprising a third partition frame partitioning said space and mounted upon said two partition frames to define said inlet or compartment, and additionally comprising a covering mounted upon at least one of the golf bag and said partition frames and shaped and positioned to extend from one end of said inlet or compartment to an opposite end thereof and over a head of the golf club to protect the head of the golf club when the club is inserted into said inlet or compartment, and means for detachably mounting said covering upon an inner surface of the golf bag, whereby the golf club, when inserted into said inlet or compartment, is protected from damage by any other clubs that might be inserted into the golf bag opening outside of said inlet or compartment.

2. The device of claim 1, wherein said two partition frames are firmly fitted upon the inner surface of the golf bag, and said third partition frame is firmly fitted upon said two partition frames.

3. The device of claim 2, wherein said third partition frame is firmly fixed to side faces of said two partition frames.

4. The device of claim 2, wherein said two partition frames and said third partition frame are formed into a single integral structure which is firmly fixed to the golf bag in the opening thereof.

5. The device of claim 4, wherein said two partition frames are substantially parallel, with the distance between said two frames being smaller than the head of the golf club to be supported, and said three frames are arranged to support the head of the golf club when inserted into said thus-defined inlet or compartment, and to protect a face of the golf club head from damage due to contact with faces of any other clubs inserted into the bag outside of said inlet or compartment.

6. The device of claim 1, wherein said two partition frames are firmly fitted upon the inner surface of the golf bag.

7. The device of claim 6, wherein said two partition frames are substantially parallel, with the distance between said two frames being smaller than the head of the golf club to be supported, and said two partition frames are arranged to support the head of the golf club across upper edges of said frames when the golf club is inserted into said thus-defined inlet or compartment.

8. The device of claim 2, wherein said third partition frame is mounted upon said two partition frames in the vicinity of ends of said two partition frames fixedly mounted upon the inner surface of the golf bag.

9. The device of claim 1, additionally comprising means for detachably mounting said cover upon said third partition frame, to thereby protect the club inserted into said inlet or compartment.

10. The device of claim 1, wherein said inlet or compartment is defined such that part of the inner surface of the golf bag constitutes an edge of said inlet or compartment, and when the golf bag is inclined in a direction towards said edge of said inlet or compartment, the golf club situated within said inlet or compartment can only contact, at most, a limited number of other clubs due to said partitioning of said space, and when the golf bag is inclined in any other direction, there is no danger of the club inserted in the inlet or compartment contacting any other clubs.

11. The device of claim 1, wherein said two partition frames are substantially parallel, extend entirely across the opening of the golf bag and are firmly fitted upon the inner surface of the golf bag at opposite ends thereof, said third partition frame is firmly fitted upon side faces of said two partition frames, and said three frames are arranged to define four separate inlets or compartments, with a smallest one of said inlets or compartments being said inlet or compartment for receiving and protecting the golf club from the other clubs and the distance between said two substantially parallel frames being smaller than the head of the golf club.

12. The device of claim 11, wherein said two partition frames are arranged to support the head of the golf club across upper edges of said frames when the golf club is inserted into said thus-defined inlet or compartment.

13. The device of claim 12, wherein said inlet or compartment is defined such that part of the inner surface of the golf bag constitutes an edge of said inlet or compartment, and when the golf bag is inclined in a direction towards said edge of said inlet or compartment, the golf club situated within said inlet or compartment can only contact, at most, a limited number of other clubs due to said partitioning of said space, and when the golf bag is inclined in any other direction, there is no danger of the club inserted in the inlet or compartment contacting any other clubs.

14. The device of claim 13, wherein a second one of said four inlets or compartments is defined between said three partition frames and the inner surface of the golf bag, and a third and fourth one of said four compartments are each defined between a respective one of said two partition frames and the inner surface of the golf bag.

15. Device for holding a golf club in a golf bag, comprising two partition frames mounted upon a golf bag in an opening thereof to define a space therebetween, and means for partitioning said space defined between said two partition frames to define an inlet or compartment for receiving a golf club, said partitioning means comprising a third partition frame partitioning said space and mounted upon said two partition frames to define said inlet or compartment, and additionally comprising a covering mounted upon at least one of the golf bag and said partition frames and shaped and positioned to extend from one end of said inlet or compartment to an opposite end thereof and over a head of the golf club to protect the head of the golf club when the club is inserted into said inlet or compartment, and means for detachably mounting said cover upon said third partition frame, to thereby protect the club inserted into said inlet or compartment, wherein said covering is fixedly mounted upon an inner surface of the golf bag, whereby the golf club, when inserted into said inlet or compartment, is protected from damage by any other clubs that might be inserted into the golf bag opening outside of said inlet or compartment.

* * * * *